United States Patent [19]

Akutsu

[11] Patent Number: 4,928,610

[45] Date of Patent: May 29, 1990

[54] SEWING MACHINE PNEUMATIC DECURLER

[75] Inventor: Hiromi Akutsu, Shioya, Japan

[73] Assignee: Juki Corporation, Tokyo, Japan

[21] Appl. No.: 265,044

[22] Filed: Oct. 31, 1988

[30] Foreign Application Priority Data

Oct. 31, 1987 [JP] Japan ..... 62-167259[U]

[51] Int. Cl.[5] ..... D05B 35/00

[52] U.S. Cl. ..... 112/153; 112/DIG. 2; 112/151; 112/235; 26/98

[58] Field of Search ..... 112/287, DIG. 2, DIG. 3, 112/153, 147, 235, 151; 26/98, DIG. 1; 271/195

[56] References Cited

U.S. PATENT DOCUMENTS

| | | | |
|---|---|---|---|
| 3,159,124 | 12/1964 | Rubin | 112/287 X |
| 3,825,250 | 7/1974 | Miller | 112/DIG. 2 |
| 4,470,362 | 9/1984 | Kear | 112/DIG. 2 |
| 4,524,707 | 6/1985 | Sander | 112/152 |
| 4,829,921 | 5/1989 | Smith | 112/151 X |

FOREIGN PATENT DOCUMENTS

| | | | |
|---|---|---|---|
| 2758262 | 7/1979 | Fed. Rep. of Germany | 112/153 |
| 59-45395 | 6/1981 | Japan . | |

OTHER PUBLICATIONS

Japanese Utility Model Application No. Sho 56-106742, "Curl Correction Apparatus for Fabric End on Sewing Machine", Laid Open: under Sho 58-11471, Jan. 25, 1983.

*Primary Examiner*—Andrew M. Falik

*Attorney, Agent, or Firm*—Morgan & Finnegan

[57] ABSTRACT

An apparatus for eliminating curls at the cut ends of fabric workpieces provides air tubes directed toward the curls so that air flow flattens the curls. The apparatus includes a device for generating air flow; a first tube connected to the device for generating air flow and having one end fixed to the presser foot of a sewing machine; a second tube connected to the device for generating air flow and having one end situated under the throat plate of a sewing machine; and a valve positioned between the device for generating air flow and the tubes. The first tube includes an opening facing the curls and a contact portion extending horizontally and overlapping the curled edge of the workpiece for contacting the curled edge when the presser foot is moved downwardly. The second tube includes an opening facing the curls. The pattern of air flow is switchable to one or both of the tubes depending on the configuration of the curls; that is, whether the fabric is outwardly curled or inwardly curled.

9 Claims, 7 Drawing Sheets

SEWING MACHINE PNEUMATIC DECURLER

FIELD OF THE INVENTION

This invention relates to an apparatus for eliminating curls formed at the cut-end of knitted fabric workpieces so that when the workpieces are sewed together along the cut-ends, such curls are flattend before being sewed.

More particularly, the invention pertains to an apparatus for flatening curls before sewing.

BACKGROUND OF THE INVENTION

It is generally known that when a knitted fabric is cut, its cut-end tends to be curled.

When such fabric workpieces are cut together and overlapped for sewing together, it is necessary to stretch the workpieces to flaten the curl before sewing the workpieces together.

FIG. 8 to FIG. 14 illustrate one conventional type of apparatus for eliminating curls described in Japanese patent publication No. 59-45395 titled "apparatus for eliminating curls", published on Nov. 6, 1984, and filed on June 9, 1981.

This apparatus includes a presser bar 101 and presser foot 102 attached to the presser bar 101. The apparatus also includes a base plate 103 fixed to a bed 104.

A first curl-eliminating body 105 is located at the front side of the presser foot 102. A slope 107, formed at the end of the first curl-eliminating body 105, is down-sloped rightwardly when viewed from an operator.

The tip end 108*a* of projection 108 is down-sloped rightwardly so that it creeps into the curled portion K of the workpiece (See FIG. 12). Arrow Y in FIG. 8 indicates the direction in which the workpiece is fed.

Another slope 109 is down-sloped towards the operator. A middle plate 110 is located under the first curl-eliminating body 105 and adapted to rotate around a shaft 106.

At the end of the middle plate 110, a projection 111 is provided. This projection 111 is larger than the projection 108 as shown in FIG. 9, and provides a slope 112 and another slope 113.

The first curl-eliminating body 105 and the middle plate 110 contact one another only at projection 108 and projection 111.

Springs 118 and 119 urge the first curl-eliminating body 105 and the middle plate 110 to rotate counter clockwise when viewed from the operator side such that the middle plate 110 is clamped between the first curl-eliminating body 105 and the base plate 103.

The base plate 103 provides a second curl-eliminating body 114 at its end. An L-shaped arm 120 is rotatably supported by a support column 120A as shown in FIG. 9, FIG. 10, and FIG. 11, and its end 120*a* contacts the surface of the first curl-eliminating body 105 as shown in FIG. 10. Another end 120*b* of the L-shaped arm 120 engages horizontal bar 101*a* which extends from the presser bar 101.

A restricting plate 121 is located between the presser foot 102 and the second curl-eliminating body 114. The restricting plate 121 contacts the edge of the workpiece W and guides the workpiece W as shown in FIG. 12.

Referring to FIG. 10, the operation of this conventional curl eliminator will be explained hereafter.

When the presser bar 101 is lifted by knee-operation, the presser foot 102 and the horizontal bar 101*a* will also be lifted, and as a result, L-shaped arm 120 rotates clockwise such that end 120*a* presses the first curl-eliminating body 105 downwardly, so that the first curl-eliminating body 105 rotates in a clockwise direction. The presser foot 102 than descends for sewing, and the horizontal bar 101*a* also descends. As a result, the L-shaped arm 120 rotates counter clockwise, and is released from pressing the first curl-eliminating body 105. Thereby, springs 118 and 119 urge the first curl-eliminating body 105 and the middle plate 110 to rotate counter clockwise such that two cloths $W_1$, and $W_2$, which constitute the workpiece W, are clamped between the middle plate 110 and the first and second curl eliminating bodies, respectively.

At this point, the sewing machine starts and the workpiece W is fed in the direction of arrow Y.

Since the operational action for both upper cloth $W_1$ of workpiece W and lower cloth $W_2$ of workpiece W are virtually the same, reference will be made to only the upper cloth $W_1$.

As the workpiece W is fed, the curl $K_1$ approaches projection 108 of the first curl-eliminating body 105, and the curl $K_1$ is smoothly introduced into the projection 108 since a slope 108T is formed in the same direction as the curling $K_1$ as shown in FIG. 13.

Since the projection 108 is situated in front of slope 107, the curl $K_1$ will be pushed rightward and stretched as the workpiece W is fed so that the curled portion diminishes.

Referring to FIG. 13, the upper cloth $W_1$ of the workpiece W is clamped between the tip end of the projection 108 and the middle plate 110. Since the contact between projection 108 and the middle plate 110 is one-point contact, when the workpiece W is pulled by the dog feed (not shown), the curl $K_1$ tends to be diminished.

As the cloth $W_1$ is further fed and passes over the slope 107, the curl $K_1$ becomes smaller as shown in FIG. 14.

Finally, the curl $K_1$ creeps in between the first curl-eliminating body 105 and the middle plate 110, and is flattened. The flattened curl $K_1$ is further fed to the presser foot 102 and is sewed by a needle N (FIG. 12).

The conventional type of eliminator just described is available, where the curls $K_1$ and $K_2$ are curled outwardly as shown in FIG. 6 as curls 15 and !6. Where, however, the curls $K_1$, and $K_2$ are curled inwardly as shown in FIG. 7 as curls 17 and 18, the conventional type of eliminator is not available. If some other curl stretching devices are provided at the middle plate 110, the structure of the conventional eliminator becomes more complicated and invites higher costs.

OBJECTS OF THE INVENTION

It is, therefore, an object of the present invention to provide a curl eliminating device which can be used when the curls at the edges of the workpiece curl inwardly as well as outwardly.

It is a further object of the present invention to provide a simple, low cost curl eliminating device.

These and other objects will be apparent to those skilled in the art from the description which follows.

SUMMARY OF THE INVENTION

It has now been found that these objectives may be achieved by the use of air pressure. According to the present invention, a first, upper air tube is provided having one end connected to an air source or means for generating air flow. An opening at the other end of the upper air tube is situated at the front side of the presser foot of a sewing device and is adapted to touch the upper of two cloth workpieces being sewn together and separate therefrom in association with the up-down movement of the presser foot.

A second, lower air tube is also provided having one end connected to an air source. An opening at the other end of the lower air tube is situated at the under side of the throat plate of a sewing device. Both openings from the first and the second air tubes are provided with nozzles such that air flowing from the nozzles is directed to flatten curls formed at the edges of the upper cloth workpiece and the lower cloth workpiece, respectively.

BRIEF DESCRIPTION OF THE DRAWINGS

A preferred embodiment of the present invention will be described in detail with reference to the following drawings.

DETAILED DESCRIPTION OF A PREFERRED EMBODIMENT

Figure 1:
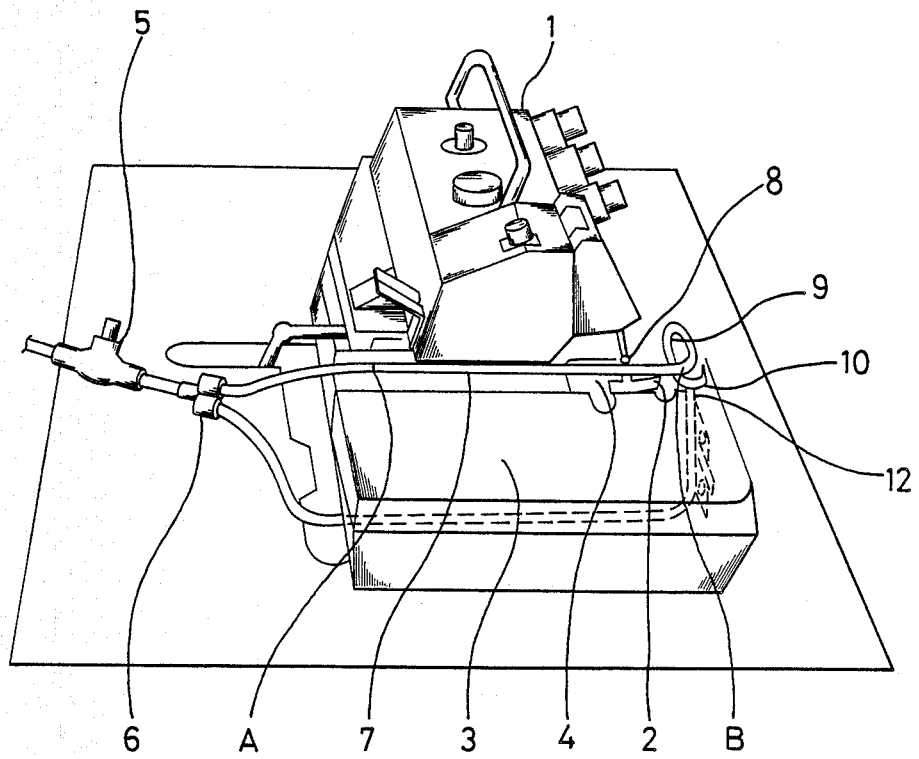
FIG. 1 is a perspective view of a curl eliminating apparatus applied to a overedge sewing machine according to the present invention.

Referring now to FIGS. 1–7 which illustrate one preferred embodiment of the present invention, numeral 1 denotes an overedging machine, having a presser foot 2, a bed 3, and a throat plate 4. The numeral 5 denotes an air throttle valve, and 6 denotes a branch-connector.

Upper nozzle tube 7 is made of metal, while the tube between the connector 6 and a connecton A is preferably made of rubber.

The upper nozzle tube 7 is fixed to the upper side of the presser foot 2 by a set screw 8, such that the upper nozzle tube 7 moves up and down in association with up and down motion of the presser foot 2.

The upper nozzle tube 7 is straight and parallel with the bed 3 from connection A to a connection B of the presser foot 2.

Figure 2:
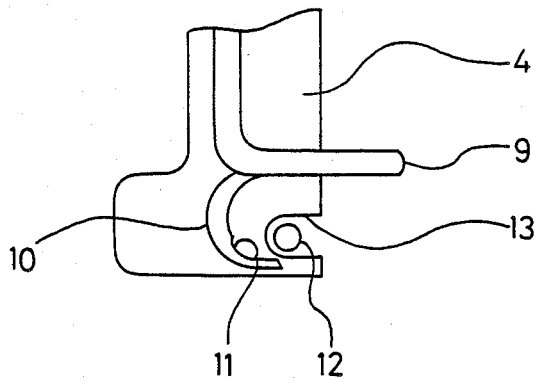
FIG. 2 is a partial plan view drawing of FIG. 1.
Figure 3:
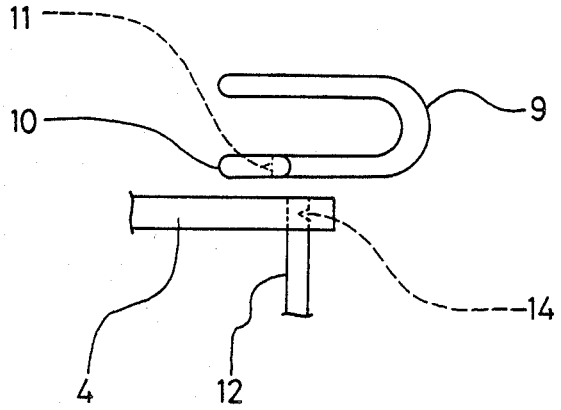
FIG. 3 is a partial front view drawing of FIG. 1.

Referring now to FIG. 2 and FIG. 3, the end of upper nozzle tube 7 has a U-shape portion 9 and a J-shaped portion 10. The J-shaped portion 10 extends horizontally and includes a leg 29. The leg 29 also constitutes a lower leg of the U-shaped portion 9.

Figure 4:
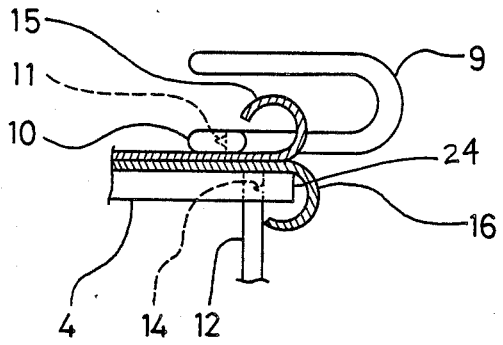
FIG. 4 is an explanatory drawing explaining how curls outwardly curled are eliminated.

The spacing between the J-shaped portion 10 and the throat plate 4 is approximately the thickness of two sheets of cloth which comprise the workpieces to be sewed as shown in FIG. 4.

J-shaped portion 10 is equipped with a nozzle 11 such that when air flows or is jetted from the nozzle 11 toward the edge of the workpiece, the air flattens the curl as shown in FIG. 4.

Figure 5:
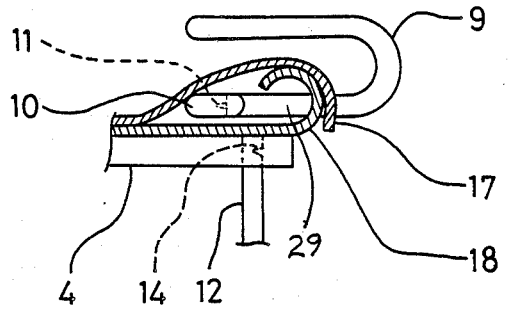
FIG. 5 is an explanatory drawing explaining how curls internally curled are eliminated.

A lower nozzle tube 12 runs from the branch-connector 6 to the under side of the bed 3 and is then turned up such that its opening, which is equipped with a nozzle 14, jets air to the edge of the workpiece to flatten the curl as shown in FIG. 4 and FIG. 5.

The end of the lower nozzle tube 12 is supported by a lower-knife-slide-stud (not shown). This lower-knife-slide-stud is adapted to move in a direction normal to the direction in which the workpiece is fed such that the overedging width can be adjusted. Thus, the lower nozzle 14 moves only when the lower-knife-slide-stud moves for adjusting the overedging width.

The end of the lower nozzle tube 12 is flush with the surface of throat plate 4; that is, is at the same level as the surface of throat plate 4. As shown in FIG. 3, the throat plate 4 is provided with U-shaped recess 13 such that the end of lower nozzle tube 12 is inserted therein as shown in FIG. 2 and FIG. 3.

Figure 6:
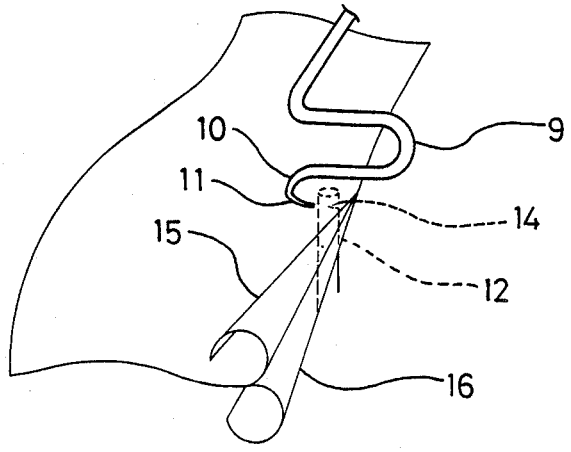
FIG. 6 is a perspective view drawing of FIG. 4.

The operation of the preferred embodiment hereinbefore described is as follows:

Referring to FIG. 4 and FIG. 6, which illustrate a situation where two sheets to be sewn together have oppositely curled edges 15 and 16, the two sheets are first overlapped. Then the presser foot 2 descends such that the J-shaped portion 10 of upper nozzle tube 7 touches the top workpiece. The curled edge 16 of the bottom workpiece extends over the edge 24 of throat plate 4 as shown in FIG. 4.

When the sewing starts, both upper nozzle 11 and lower nozzle 14 jet air simultaneously. The air flow from the upper nozzle 11 flattens curled edge 15 of the upper workpiece. The air flow from the lower nozzle 14 flattens curled edge 16 of the lower workpiece. As the workpieces are fed, the J-shaped portion 10 of upper tube 7, which overlaps the curled edge 16 of the upper workpiece as shown in FIG. 4 and FIG. 6 further flattens the workpieces. Although most of the curl is flattened by air flow, a small curl may remain. It is the remaining small curl, if any, which will be flattened by the J-shaped portion 10 of upper nozzle tube 7.

Figure 7:
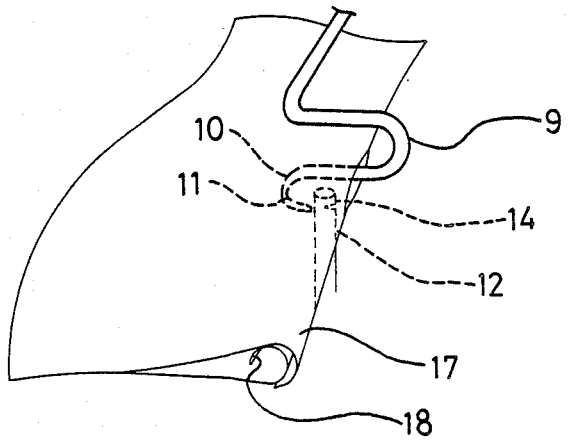
FIG. 7 is a perspective view drawing of FIG. 5.
Figure 8:
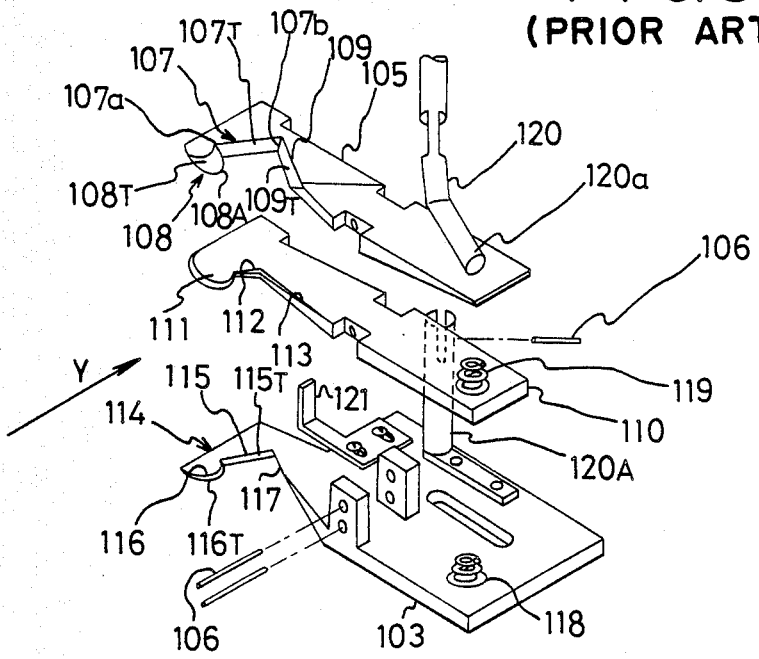
FIG. 8 (PRIOR ART)
FIG. 8 is a perspective view drawing of a conventional curl eliminating apparatus.
Figure 9:
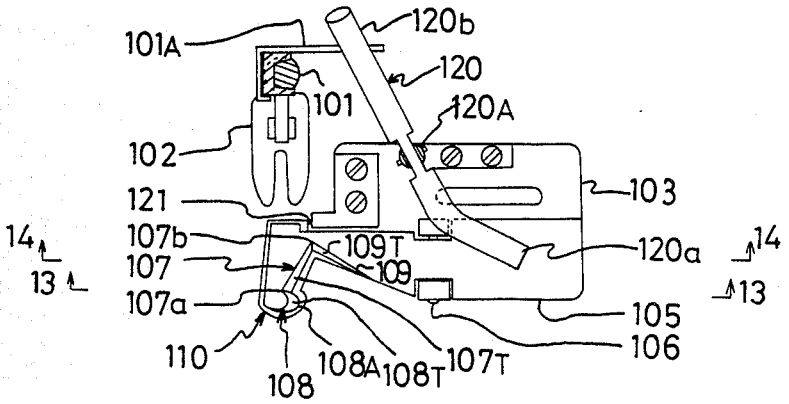
FIG. 9 (PRIOR ART)
FIG. 9 is a plan view drawing of FIG. 8.
Figure 10:
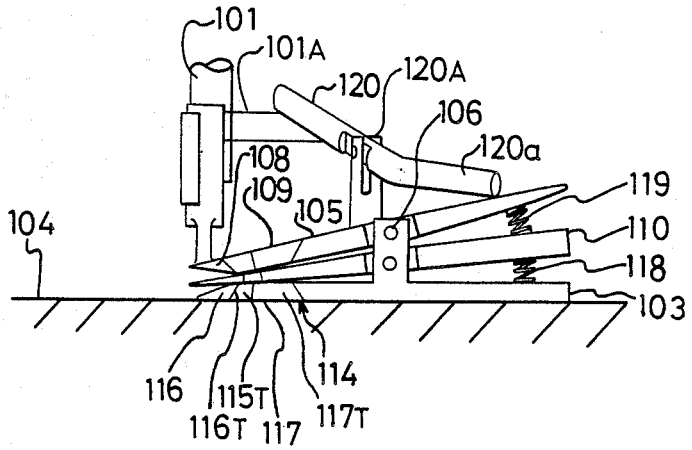
FIG. 10 (PRIOR ART)
FIG. 10 is a front view drawing of FIG. 8.
Figure 11:
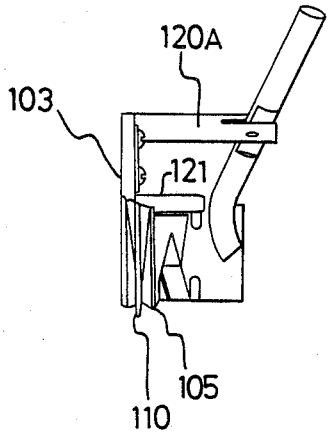
FIG. 11 (PRIOR ART)
FIG. 11 is a partial left side view drawing of FIG. 9.
Figure 12:
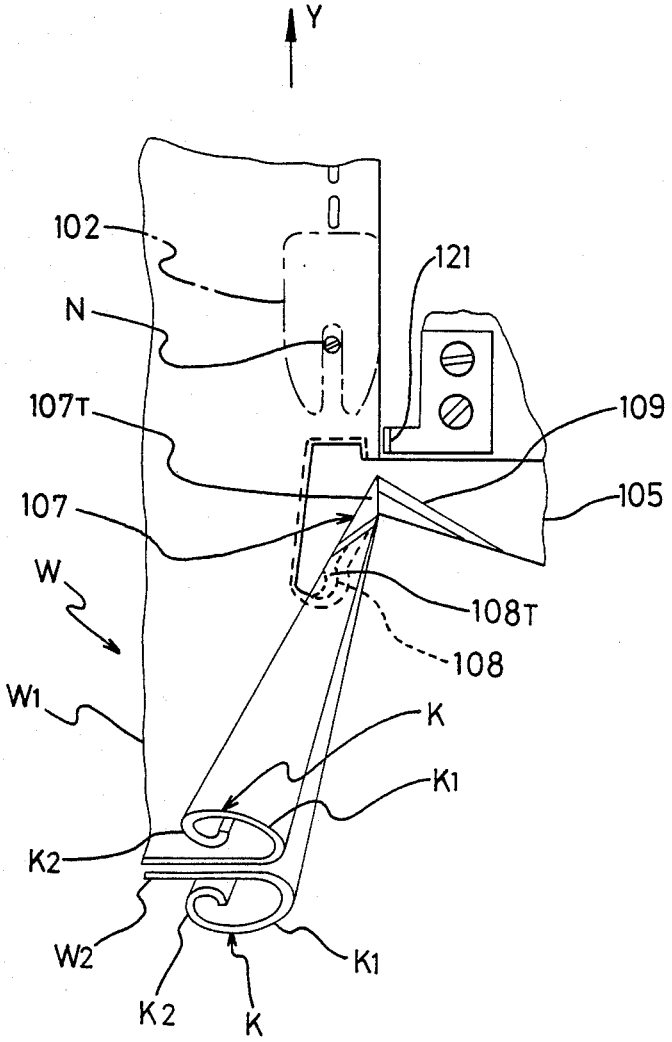
FIG.12 (PRIOR ART)
FIG. 12 is a partial plan view of essential portion of conventional curl eliminator when a workpiece is placed and fed.
Figure 13:
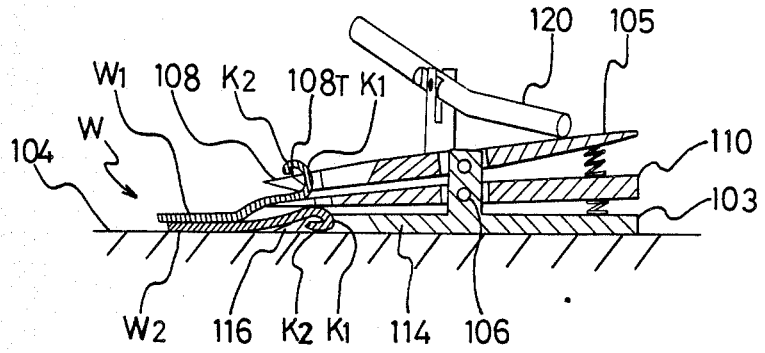
FIG. 13 (PRIOR ART)
FIG. 13 is a sectional drawing viewed in direction of arrow 13—13 in FIG. 9.
Figure 14:
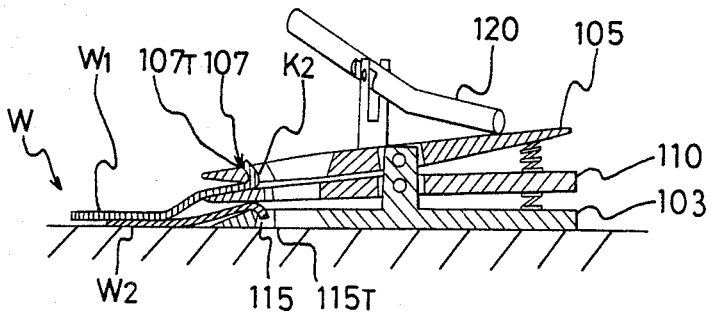
FIG. 14 (PRIOR ART)
FIG. 14 is a sectional drawing viewed in direction of arrow 14—14 in FIG. 9.

Referring to FIG. 5 and FIG. 7, where the ends of the workpieces curl toward one another, the upper workpiece is placed to cover lower leg 29 of the U-shaped portion 9 and the lower workpiece is placed under the lower leg 29 of the U-shaped portion 9. When the sewing starts, both upper nozzle 11 and lower nozzle 14 jet air simultanously.

Both curled edge 17 in the upper workpiece and curled edge 18 in the lower workpiece are flattened by the air flow from the upper nozzle 11. As the workpiece is fed further, the curl 17 in the upper workpiece will be squeezed between the presser foot 2 and the lower leg 29 of the U-shaped portion 9. The curl 18 in the lower workpiece will be squeezed between the U-shaped portion 9 and the throat plate 4. As aforementioned, large curls will be flattened by the air flow and any smaller remaining curls will be flattened by the lower leg 29 of U-shaped portion 9.

As previously described, where the edges are inwardly curled, air is jetted simultaneously from both upper nozzle 11 and lower nozzle 14. In another embodiment, it is possible to jet air only from the upper nozzle 11 by changing the branch-connector 6 to a branch connector which is capable of being switched so as to provide a flow of air to either the upper nozzle tube 7 alone, the lower nozzle tube 12 alone, or both simultaneously, as needed. Any suitable means of regulating air flow, such as a solenoid or pneumatic valve, can be used to create the appropriate flow of air through the branch connector.

Although particular preferred embodiments of the present invention have been described herein, the present invention is not limited to these particular embodiments. Various changes and modifications may be made thereto by those skilled in the art without departing from the spirit or scope of the invention, which is defined by the appended claims.

What is claimed is:

1. An apparatus for eliminating curls at the edge of a first fabric workpiece before sewing the first fabric workpiece to a second fabric workpiece along the curled edge on a sewing device having a vertically movable presser foot and a throat plate, the curl eliminating apparatus comprising:

means for generating air flow;

a first tube having a first end portion connected to said means for generating air flow and a second end portion fixed on the presser foot, said second end portion including an opening facing said curls and a contact portion extending horizontally and overlapping said curled edge of said first fabric workpiece for contacting with said curled edge when said presser foot moves downwardly;

a second tube having a first end connected to said means for generating air flow and a second end situated under the throat plate and including an opening facing said curls, and a valve positioned between said means for generating air flow and first and second tubes for controlling air flow.

2. An apparatus for eliminating curls, as recited in claim 1, wherein said first end portion of said first tube has a flexible portion.

3. An apparatus according to claim 1 wherein said first tube further has an intermediate portion between said first and second end portions of said first tube, and said second end portion of said first tube further includes a vertical portion connecting said contact portion with said intermediate portion.

4. An apparatus according to claim 1 wherein said contact portion is positioned behind the presser foot in a feed direction of said fabric workpiece.

5. In a sewing machine, an apparatus for eliminating curl at an edge of a fabric workpiece comprising:

a tube having an end portion including an opening for jetting an air flow facing said curl to flatten said curl and a contact portion which extends horizontally to overlap said curled edge of said fabric workpiece; and means for moving said tube vertically to bring said contact portion into contact with said fabric workpiece to additionally flatten said curl.

6. An apparatus according to claim 5 wherein said end portion of said tube is positioned behind a needle of said sewing machine in a feed direction of said fabric workpiece.

7. In a sewing machine, an apparatus for eliminating curl at an edge of a fabric workpiece comprising:

means for generating air flow;

a first tube having a first portion connected to said means for generating air flow, a second portion having an opening facing said curled edge for flattening said curl, and a third portion extending substantially straight between said first and second portion;

said second portion including a contact portion horizontally extending below said third portion and overlapping said curled edge and a vertical portion connecting said contact portion with said third portion;

means for moving vertically said second and third portions of said first tube to bring said contact portion in contact with said fabric workpiece to flatten said curl in addition to said first-mentioned flattening; and a second tube having an end connected to said means for generating air flow and an other end including an opening positioned under the throat plate and facing said curl.

8. An apparatus according to claim 7 wherein said first end portion of said first tube comprises a flexible portion.

9. An apparatus according to claim 7 wherein said contact portion is positioned behind a needle of said sewing machine in a feed direction of said fabric workpiece.

* * * * *